US005082038A

United States Patent [19]

Teel

[11] Patent Number: 5,082,038

[45] Date of Patent: Jan. 21, 1992

[54] DOOR FABRICATION STATION

[76] Inventor: Jeff A. Teel, 1851-B West Vista Way, Suite 315, Vista, Calif.

[21] Appl. No.: 625,964

[22] Filed: Dec. 11, 1990

[51] Int. Cl.[5] ..... B25H 1/00

[52] U.S. Cl. ..... 144/286 A; 83/471.2; 83/574; 108/13; 108/65; 108/102; 144/286 R; 269/289 R; 269/309; 269/901

[58] Field of Search ..... 83/471.2, 574; 108/12, 108/13, 28, 65, 78, 90, 92, 96, 102; 269/289 R, 303, 309, 901; 144/286 R, 286 A

[56] References Cited

U.S. PATENT DOCUMENTS 4,230,329 10/1980 Johnson ..... 144/286 A
5,005,616 4/1991 Moshe ..... 144/286 A

OTHER PUBLICATIONS

Photograph #1 showing prior art door support table.
Photograph #2 showing prior art door support table.
Photograph #3 showing prior art door support table.

*Primary Examiner*—W. Donald Bray
*Attorney, Agent, or Firm*—Baker, Maxham Jester & Meador

[57] ABSTRACT

A door fabrication station for sawing, planing, routering and mounting hardware on a door includes an upper door support frame for supporting a door in a generally horizontal position, a leg assembly extending below the door support frame to a surface on which the door fabrication station is to be supported, the leg assembly contacting the surface at one or more locations defining an area of surface contact, a lower door support mounted within the area of surface contact for supporting a door in generally vertical position, and an upper door support mounted above the lower door support for providing additional door support in the generally vertical position.

12 Claims, 5 Drawing Sheets

FIG. 9
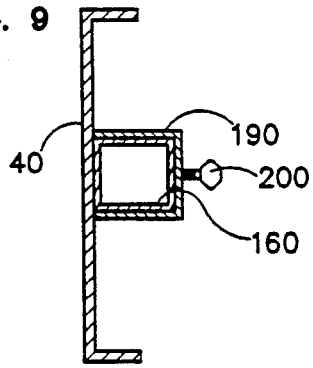
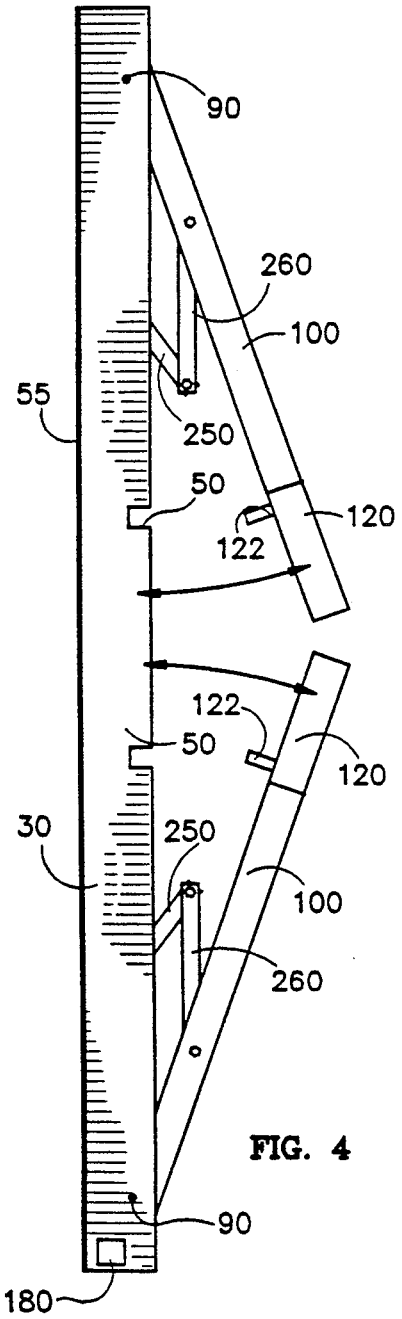
FIG. 4
FIG. 2
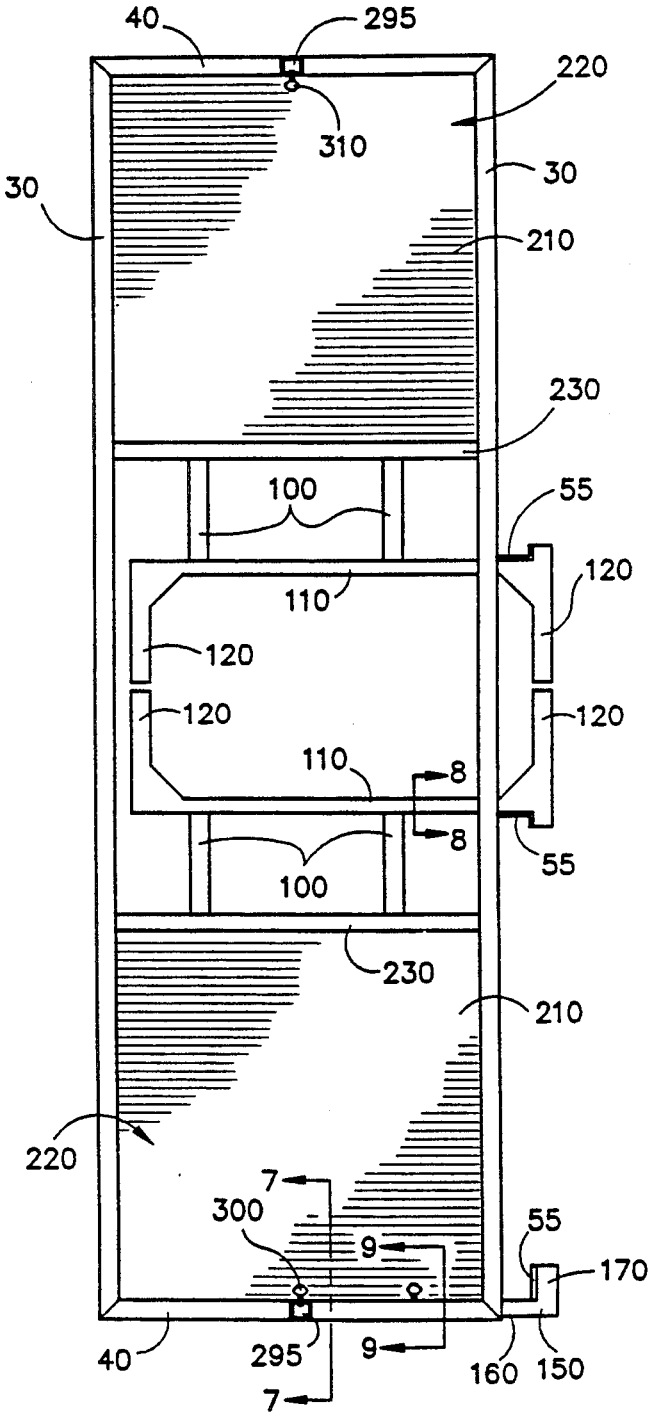

DOOR FABRICATION STATION

BACKGROUND OF THE INVENTION

The present invention relates to building construction, and more particularly, to the fabrication, modification, sizing, fitting and installation of doors, and still more particularly, to a construction implement to assist in the above-stated functions for maximum time saving efficiency and reduced construction cost.

In the construction of buildings, and particularly wood frame structures such as residential housing, significant effort is often directed to the preparation and installation of doors. Virtually all doors must be cut at the bottom to accommodate for carpet, tile or other flooring materials. In most cases, the door must also be planed. Additionally, the door must be routered to permit hinge mounting and the hinges must be secured to the door. Once the door itself is prepared and mounted, the door trim must be fabricated. This usually requires the use of miter saw, or chop saw.

Because doors and trim stock are rather large, bulky and ponderous to handle, the carpenter's operating efficiency may be adversely affected if the door or trim materials are not advantageously positioned or if the carpenter must hold the workpiece while sawing, planing or routering. If the door or trim member is resting on the floor, for example, the carpenter may have to repeatedly bend over the work piece. If the piece is being sawed, the carpenter may support it on blocks or supports to keep the saw blade from contacting the ground and to steady the work piece. This positioning may be unstable and dangerous. If routering or planing, the carpenter may elect to hold the door in position. Again, this may present an undue safety hazard in which the work piece could move and the power tool slip. Finally, if the carpenter is installing hardware on the door, the hardware and associated fastener materials will often be placed on the floor where they may be misplaced or lost.

These disadvantages invariably decrease construction efficiency and increase overall project cost. Accordingly, an apparatus and system directed to expediting the above-described aspects of the construction process would be desirable.

SUMMARY OF THE INVENTION

It is therefore a primary object of the present invention to provide a construction apparatus which expedites the preparation, modification, sizing and installation of doors and door trim molding.

It is a further object of the present invention to provide a construction apparatus which enhances construction efficiency.

It is a further object of the present invention to provide a construction apparatus which reduces construction costs.

In accordance with one aspect of the invention, a door fabrication station for sawing, planing, routering and mounting hardware on a door includes an upper door support frame for supporting a door in a generally horizontal position. A leg assembly extends below the door support frame to a surface on which the door fabrication station is to be supported, and the leg assembly contacts the surface at one or more locations defining an area of surface contact. A lower door support is mounted within the area of surface contact for supporting a door in generally vertical position, and an upper door support is mounted above the lower door support for providing additional door support in the generally vertical position. In accordance with another aspect of the invention, the door fabrication station is collapsible and fully adjustable. In still another aspect of the invention, the door fabrication station may include a miter saw or chop saw support station and work piece support members to support an article for sawing.

BRIEF DESCRIPTION OF THE DRAWINGS

The objects, features and advantages of the present invention will be more readily appreciated from the ensuing detailed description when considered in conjunction with the accompanying drawing in which:

FIG. 2 is a top plan view of the door fabrication station of FIG. 1;

FIG. 4 is a side elevational view of the door fabrication station of FIG. 1 in a partially collapsed position;

FIG. 9 is a detailed cross-sectional view taken along line 9—9 in FIG. 2.

DESCRIPTION OF THE PREFERRED EMBODIMENTS

Figure 1:
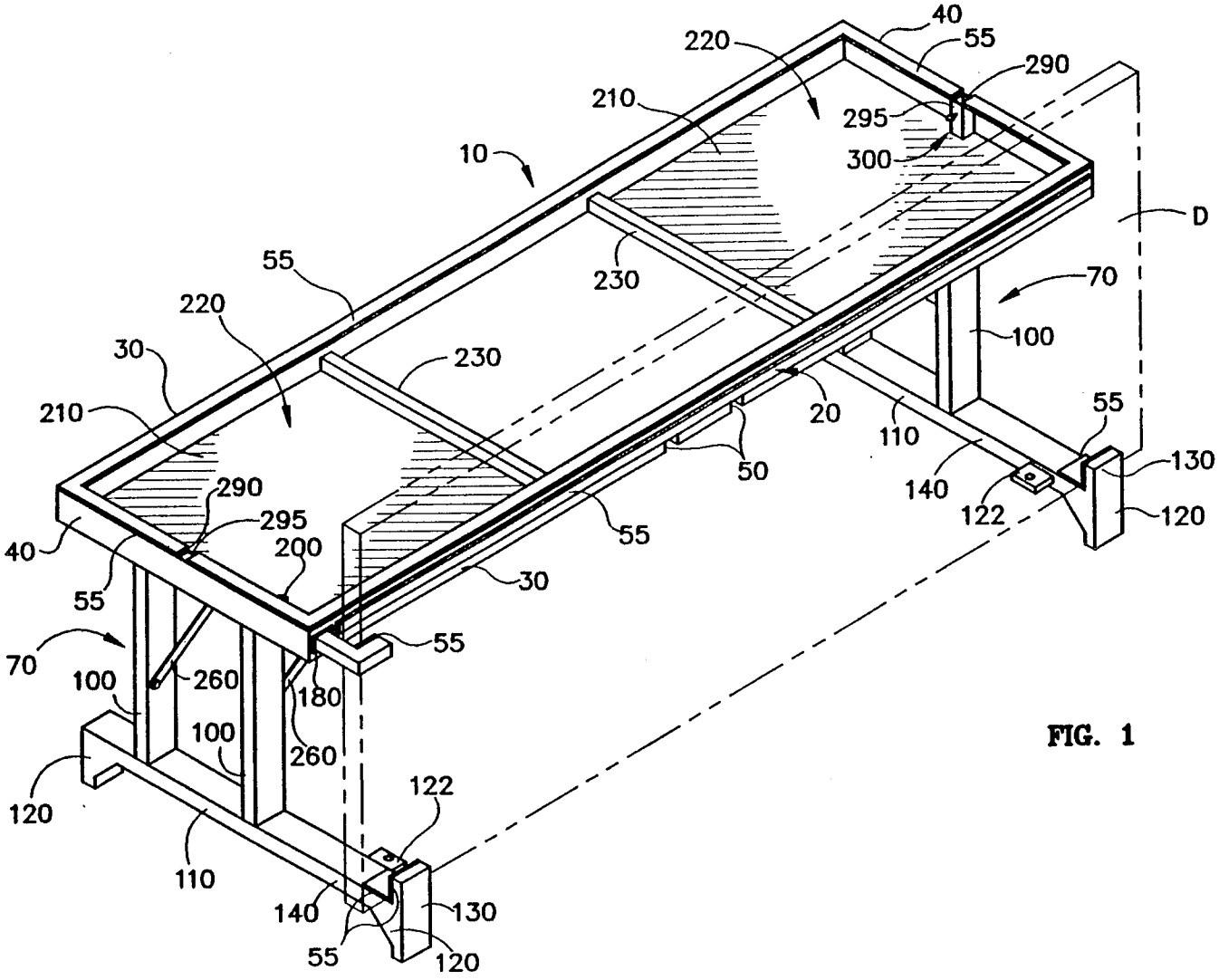
FIG. 1 is a detailed perspective view of a door fabrication station constructed in accordance with the present invention.

Referring to FIG. 1, a door fabrication station 10 includes an upper door support frame 20 having a pair of longitudinal frame members 30 and a pair of transverse frame members 40. The door support frame 20 holds a door in a generally horizontal position for sawing. The frame members are preferably formed from a lightweight material such as aluminum channel stock and include upper and lower flanges and a central web section. The frame members 30 and 40 are assembled together to form a parallelogram, preferably of rectangular shape.

One of the longitudinal frame members 30 includes a pair of notched recesses 50 formed in the bottom flange and extending into the central web portion thereof. The upper door support frame 20 has mounted along its upper flanges a strip of nylon material 55 to reduce friction and protect door finishes. The door frame 20 is supported on a surface 60 by means of a pair of leg assemblies 70 that are pivotally mounted to the door support frame 20. As shown in more detail in FIG. 3, each leg assembly 70 includes a transverse pivotal support member 80 which may be conveniently formed from aluminum tube stock. The pivotal supports 80 are pivotally mounted about a pair of pivotal support rods 90 that are mounted to the door support frame members 30. The pivotal support rods 90 may be conveniently formed from aluminum tube stock and welded to the central web portion of the longitudinal frame members 30.

The leg assemblies 70 are pivotally mounted to the door support frame 20 at locations adjacent to the transverse frame members 40, and pivot between horizontal and perpendicular positions with respect to the door support frame 20. In the horizontal position, the leg assemblies 70 extend toward each other at a central portion of the longitudinal frame members 30.

The leg assemblies 70 further include a pair of vertical support struts 100 which may be conveniently formed from aluminum tube stock and are welded to extend generally perpendicularly from the transverse pivotal supports 80 and parallel to each other. The opposing ends of the vertical support struts 100 are welded to a pair of transverse leg support members 110 that are mounted generally perpendicularly to the vertical support struts 100. The transverse leg support members 110 are preferably formed from aluminum tube stock. Perpendicularly mounted at the ends of the transverse leg support members 110 are a pair of support legs 120 that are also preferably formed from aluminum tube stock. In the horizontal leg assembly position, the support legs 120 extend from the transverse support members 110 toward each other. In the vertical leg assembly position, the support legs 120 extend downwardly to contact the surface 60 upon which the door fabrication station 10 is positioned.

Figure 3:
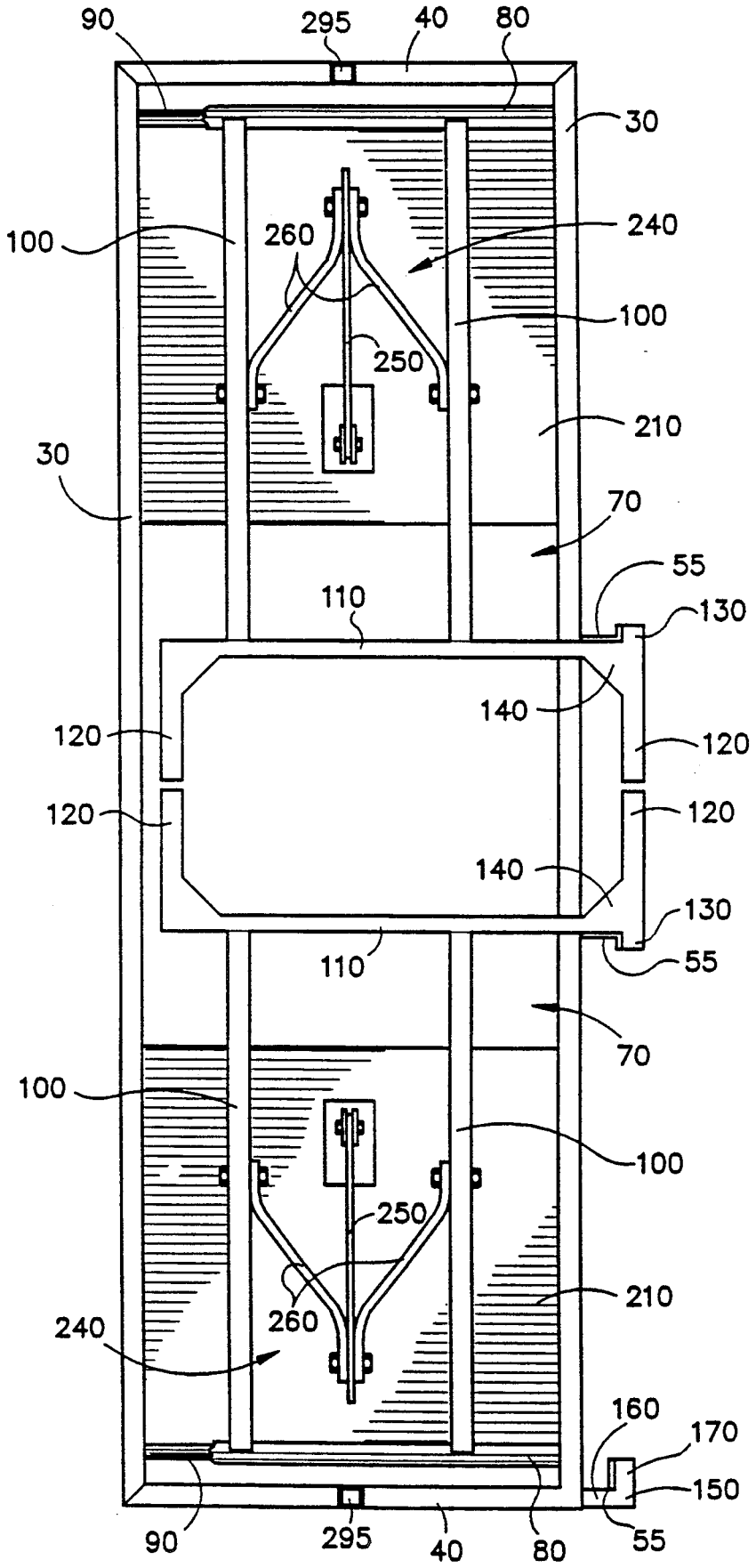
FIG. 3 is a bottom plan view of the door fabrication station of FIG. 1.
Figures 5, 7:
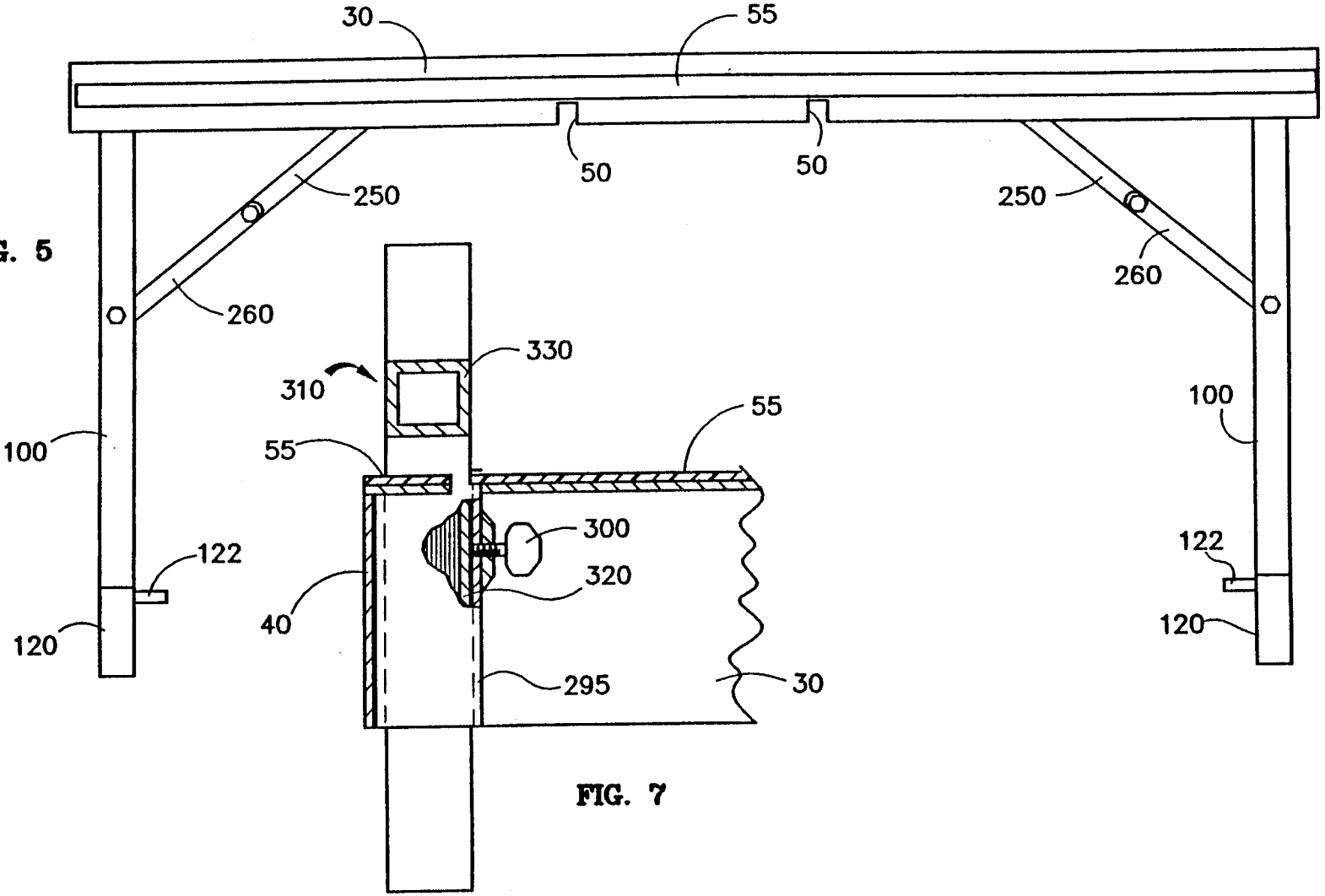
FIG. 5 is a side elevational view of the door fabrication station of FIG. 1 in a fully open position.
FIG. 7 is a detailed cross-sectional view taken along line 7—7 in FIG. 6.

As shown in FIGS. 2 and 3, one pair of the support legs 120 at one end of the transverse support members 110 are positioned within the periphery of the frame 20 when the leg assemblies 70 are in the horizontal position. The remaining pair of support legs 120 extend outside of the periphery of the support frame 20. It will be appreciated that opposing support legs 120 of each assembly 70 are placed in close spaced relation to each other when the leg assemblies are in the horizontal position. In this manner, the support legs 120 positioned outside the frame 20 provide a handle for carrying the door fabrication station 10 for efficient transportation to and from a job site.

Figure 8:
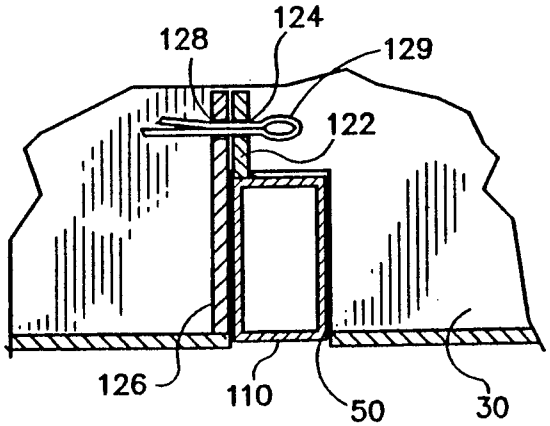
FIG. 8 is a detailed cross-sectional view taken along line 8—8 in FIG. 2.

As shown in FIG. 8, the transverse support members 110 of the leg assemblies 70 are nested within a respective frame member recess 50 when the leg assemblies are in the horizontal position. In that position, the transverse support members 110 may be locked to the longitudinal frame member 30 through which they extend such that the leg assemblies 70 may be locked in the horizontal storage position. Thus, the transverse support members include a lock tab 122 extending from one side thereof having a hole 124 therein. Similarly, the longitudinal frame 30 includes a pair of lock tabs 126 extending from one side of the recesses 50, having a hole 128 therein. A pin 129 may be positioned in the holes 124 and 128 to secure the leg assemblies 70 in their horizontal storage position.

As shown in FIGS. 2 and 3, the support legs 120 extending beyond the periphery of the frame 20 include an upper extension 130 extending above the transverse members 110 in the vertical leg assembly position. The vertical extensions 130, in conjunction with an immediately adjacent portion 140 of the transverse members 110, together form a lower door support for supporting a door D in a generally vertical position for planing, routering or hinge attachment. The lower door support is within the perimeter of the area formed by the points of contact of the support legs 120 on the surface 60. Thus, the placement of a door on the lower support will not result in an overturning moment that could topple or render unstable the door fabrication station 10.

Mounted to the upper door support frame 20 is an adjustable upper door support 150 positioned above the lower door supports 140 to support a door D in the generally vertical position. The upper door support 150 includes a stem portion 160 and an arm portion 170 extending generally perpendicularly from one end of the stem portion 160. The upper door support 150 is mounted at the end of the longitudinal frame member 30 having the recesses 50 form therein. To accommodate the upper door support stem portion 160, the longitudinal frame member 30 includes a notched recess 180 through which is slideably mounted the stem portion 160 of the upper door support 150. As further shown in FIG. 9, there is mounted to the adjacent transverse frame member 40 a channel 190 within which the upper door support stem portion 160 is itself mounted. A thumb screw 200 is threadably mounted through the channel 190 and locks the upper door support 150 in a selected adjustment position.

The upper door support 150 is adjustable to support a door in a vertical position between the upper door support arm member 170 and the adjacent longitudinal frame member 30. Preferably, the upper door support arm portion 170 have mounted thereon the same nylon stripping 55 that is mounted to the top of the frame members 30 and 40 to protect the surface of the door. The lower door support 140 and vertical extension 130 of the support legs 120 include similar stripping 55.

Referring now to FIGS. 2 and 3, a pair of plates 210, preferably formed from aluminum sheet stock, are secured to the central webs of the transverse frame members 40 and the adjacent longitudinal frame members 30 to form a pair of tool support wells 220 for supporting tools or other implements below the top of the door support frame 20. The tool wells 220 extend from the adjacent transverse frame member 40 toward the midportion of the support frame 20. At the interior end of the plates 210, there may be optionally mounted a transverse stop member 230 that extends between the longitudinal frame members 30 to provide a complete walled enclosure around the plates 210.

As shown in FIG. 3, the leg assemblies 70 are stabilized by a stabilizing assembly 240. The stabilizing assemblies 240 include an upper stabilizing bar 250 that is pivotally mounted to the underside of the plate 210. The stabilizing assemblies 240 further include a pair of lower stabilizing bars 260 that are pivotally mounted at one end to the free end of the upper stabilizing bar 250, and at their other end to the vertical support members 100 of the leg assemblies 70. The stabilizer assemblies 240 include the usual tabs (not shown) formed on the lower stabilizing bars 260 that engage the upper stabilizing bar 250 to lock the stabilizing assembly 240 in an overcenter position when the leg assemblies are in their vertical support position. Thus, closure of the leg assemblies 70 is prevented until the stabilizer assemblies 240 are released from their overcenter locked position.

Figure 6:
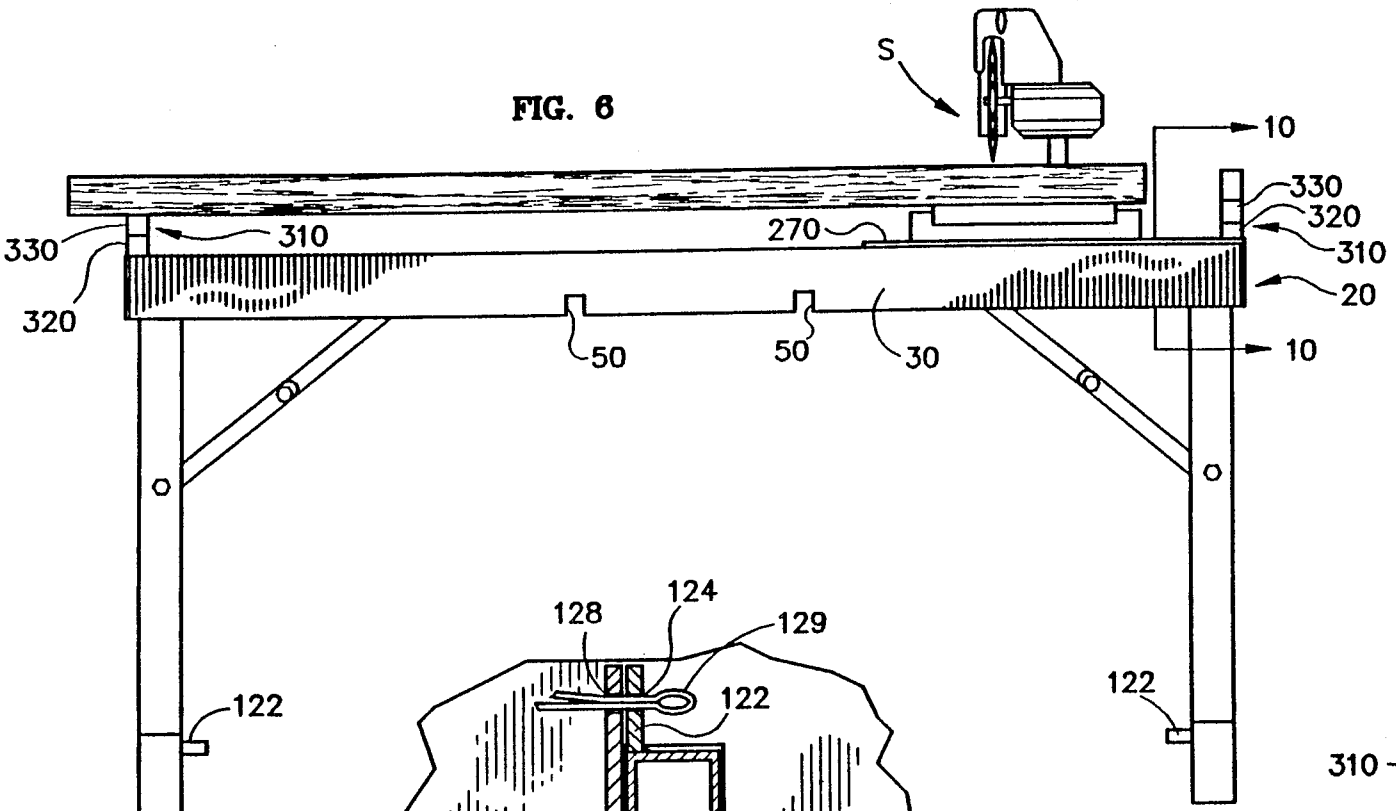
FIG. 6 is an elevational side view of the door fabrication station of FIG. 1 in a fully open position and adapted for chop saw operation.
Figure 10:
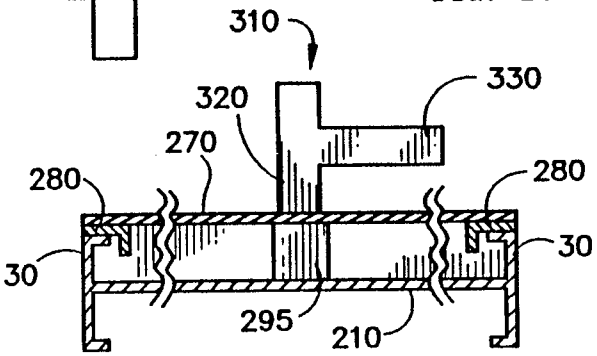
FIG. 10 is a detailed cross-sectional view taken along line 10—10 in FIG. 6.

Referring now to FIG. 6, a miter saw or chop saw support plate 270 may be removably and slideably mounted on the top of the door support frame 20. As shown in FIG. 10, the saw support plate 270 is preferably formed from aluminum sheet stock and includes a pair of angles 280 on the underside thereof that engage the longitudinal frame members 30 to stabilize the saw support plate 270 and guide it along the frame 20. Thus, a miter saw or chop saw placed on the saw support plate 270 may be positioned at any location along the door fabrication station 10 as necessary to saw articles of variant size. As shown in FIG. 6, the miter saw or chop saw is supported on the saw plate 270 at a selected height that depends in part on the characteristics of the saw.

There is additionally provided in the upper flanges of the transverse frame members 40, at the approximate midpoint thereof, a notched recess 290. There is mounted to the interior webs of the transverse frame members 40 a channel 295 having threadably mounted therein a thumbscrew adjustment 300. There are removably mounted in the channels 295 a pair of trimstock supports 310. The trimstock supports 310 include a vertical stem portion 320 that is slideably mounted in the channels 290 and locks in position by the thumbscrew adjustment 300. Extending perpendicularly from the stem portions 320 and slightly below the top thereof, are a pair of transverse trimstock support portions 330 adapted to support an article for sawing. To saw the article, the trimstock supports 310 are vertically adjusted such that the tops of the transverse support arms 330 are level with the working surface of the miter saw or chop saw. In this manner, a workpiece of excessive length can be safely and properly supported during the sawing operation. The carpenter is thus free to concentrate on the sawing operation and need not also hold and balance the article in the correct position.

Accordingly, a novel door fabrication station has been described. While several preferred embodiments have been disclosed, it should be understood that modifications and adaptations thereof will occur to persons skilled in the art. For example, there could be placed in the tool support wells 220 a table saw for sawing in the longitudinal direction of the table. The trimstock supports 310 could be modified such that the transverse support portions thereof are cylindrical and rotatably connected to the stem portions 320 such that the stock could be fed through the saw on roller supports. Therefore, the protection afforded the invention should not be limited except in accordance with the spirit of the following claims and their equivalents.

I claim:

1. A door fabrication station for sawing, planing, routering and mounting hardware on a door, comprising:

an upper door support frame for supporting a door in a substantially horizontal position, said support frame including a pair of longitudinal frame members and a pair of transverse frame members arranged to form substantially a parallelogram, said frame members having a top, a bottom and an intermediate section extending betwee said top and bottom portions, one of said longitudinal frame members having a pair of recesses formed in the bottom thereof and further having a slot at one end thereof extending transversely therethrough, both of said transverse frame members having a slot extending vertically therethrough, and one of said transverse frame members having a transversely extending channel aligned with said transverse slot in said one of said longitudinal frame members;

a pair of tool support plates mounted to said frame members at said intermediate section thereof, said plates extending from a respective transverse frame member toward the other transverse frame member a distance sufficient to provide an area for storing tools, fasteners or other materials;

a pair of leg assemblies pivotally mounted to said longitudinal frame members adjacent said transverse support members and below said plate members, said leg assemblies including a lower transverse member terminating at a pair of support legs, said transverse members including a lower door support surface between and adjacent one of said support legs for supporting a door in a generally vertical position;

an upper door support member having a stem portion slideably mounted in said transverse slot in said one of said longitudinal frame members and in said transverse channel in said one of said transverse frame members, said upper door support member further having an arm extending from one end of said stem portion to engage one side of a door supported on said lower door support surface, said upper door support member being slideably adjustable to support another side of said door against said one of said longitudinal door support frames;

a threaded fastener extending in said transverse channel and engaging said upper door support member in a selected position of adjustment in accordance with the thickness of a door being generally vertically supported;

a pair of trim stock supports, said trim stock supports including a stem portion slideably mounted in said vertically extending channels in said transverse door support frames, and a transverse portion adapted to support an article to be sawed between said trim stock supports;

a threaded fastener extending in said vertically extending channels and engaging said stem portion of said trim stock supports in a selected position of vertical adjustment in accordance with the height at which a work piece must be positioned for sawing; and an upper saw support table removably and slideably mounted on the top of said longitundinal frame members for supporting a miter or chop saw for sawing a work piece.

2. A door fabrication station for sawing, planing, routering and mounting hardware on a door, comprising:

an upper door support frame for supporting a door in a generally horizontal position;

a leg assembly extending below said door support frame to a surface in which the door fabrication station is to be supported, said leg assembly contacting said surface at one or more locations defining an area of surface contact;

a lower door support mounted within said area of surface contact for supporting a door in a generally vertical position;

an upper door support mounted above said lower door support for supporting a door in said generally vertical position; and said leg assembly further including a pair of leg assemblies each having a pair of leg support members contacting said surface, said lower door support being formed of a transverse portion of each leg assembly, and each said lower door support being positioned between said leg support members.

3. A door fabrication station for sawing, planing, routering and mounting hardware on a door, comprising:

an upper door support frame for supporting a door in a generally horizontal position;

a leg assembly extending below said door support frame to a surface in which the door fabrication station is to be supported, said leg assembly contacting said surface at one or more locations defining an area of surface contact;

a lower door support mounted within said area of surface contact for supporting a door in a generally vertical position;

an upper door support mounted above said lower door support for supporting a door in said generally vertical position; and wherein said upper door support frame includes a pair of transverse frame members and a pair of longitudinal frame members, said leg assembly including a pair of leg assemblies pivotally mounted to said upper door support frame adjacent said transverse frame members, and being pivotable between substantially horizontal and substantial vertical positions with respect to said upper door support frame, said leg assemblies including pairs of support legs, said pairs of support legs extending toward each when said leg assemblies are in said horizontal position, and one leg of each of said pairs of said support legs providing a carrying handle in said leg assembly horizontal position, said carrying handle/support legs extending outside said upper door support frame.

4. A door fabrication station for sawing, planing, routering and mounting hardware on a door, comprising:

an upper door support frame for supporting a door in a generally horizontal position;

a leg assembly extending below said door support frame to a surface in which the door fabrication station is to be supported, said leg assembly contacting said surface at one or more locations defining an area of surface contact;

a lower door support mounted within said area of surface contact for supporting a door in a generally vertical position;

an upper door support mounted above said lower door support for supporting a door in said generally vertical position; and wherein said upper door support includes a stem portion slideably mounted in and extending perpendicularly from an end portion of said upper door support frame, said upper door support further including an arm portion extending parallel to said upper door support frame, said upper door support being slideably positionable to position said arm relative to said upper door sv port frame to secure a door in a generally vertical position between said arm and said frame.

5. The door frabrication station of claim 4 including a lock to secure said upper support in a selected position of adjustment.

6. A door fabrication station for sawing, planing, routering and mounting hardware on a door, comprising:

an upper door support frame for supporting a door in a generally horizontal position;

a leg assembly extending below said door support frame to a surface in which the door fabrication station is to be supported, said leg assembly contacting said surface at one or more locations defining an area of surface contact;

a lower door support mounted within said area of surface contact for supporting a door in a generally vertical position;

an upper door support mounted above said lower door support for supporting a door in said generally vertical position; and a pair of tool storage wells formed by plates extending across interior end portions of said upper door support frame, and below an upper surface thereof.

7. The door fabrication of claim 6 wherein said storage wells further include a pair of walls mounted at interior end portions of said plates, and extending between opposing sides of said upper door support frame.

8. A door fabrication station for sawing, planing, routering and mounting hardware on a door, comprising:

an upper door support frame for supporting a door in a generally horizontal position;

a leg assembly extending below said door support frame to a surface in which the door fabrication station is to be supported, said leg assembly contacting said surface at one or more locations defining an area of surface contact;

a lower door support mounted within said area of surface contact for supporting a door in a generally vertical position;

an upper door support mounted above said lower door support for supporting a door in said generally vertical position; and a pair of trim stock support members slideably mounted at end portions of said upper door support frame for vertical adjustment with respect to said door support frame, said door fabrication station further including a saw support table removable and slideably mounted on said door support frame for supporting a miter or chop saw for sawing a work piece supported on said trim stock support members.

9. A door fabrication station for sawing, planing, routering and mounting hardware on a door, comprising:

an upper door support frame for supporting a door in a generally horizontal position;

a leg assembly extending below said door support frame to a surface in which the door fabrication station is to be supported, said leg assembly contacting said surface at one or more locations defining an area of surface contact;

a lower door support mounted within said area of surface contact for supporting a door in a generally vertical position;

an upper door support mounted above said lower door support for supporting a door in said generally vertical position; and a strip of low friction belting mounted on said upper door support frame for slideably supporting a door on said door support frame.

10. A door fabrication station for sawing, planing, routering and mounting hardware on a door, comprising:

an upper door support frame for supporting a door in a generally horizontal position;

a strip of low friction belting mounted on said upper door support frame for slideably supporting a door on said support frame;

a pair of leg assemblies pivotally mounted to said upper door support frame, said leg assemblies being pivotable between substantially horizontal and substantially vertical positions with respect to said upper door support frame;

a pair of lower door supports mounted to said leg assemblies for supporting a door in a substantially vertical position;

an upper door support adjustably mounted to said upper door support frame for supporting a door in a substantially vertical position, said upper door support frame being adjustable to receive doors of varying thickness; and said upper door support including a thumb screw adjustment.

11. A door fabrication station for sawing, planing, routering and mounting hardware on a door, comprising:

an upper door support frame for supporting a door in a generally horizontal position;

a strip of low friction belting mounted on said upper door support frame for slideably supporting a door on said support frame;

a pair of leg assemblies pivotally mounted to said upper door support frame, said leg assemblies being pivotable between substantially horizontal and substantially vertical positions with respect to said upper door support frame;

a pair of lower door supports mounted to said leg assemblies for supporting a door in a substantially vertical position;

an upper door support adjustably mounted to said upper door support frame for supporting a door in a substantially vertical position, said upper door support frame being adjustable to receive doors of varying thickness; and said leg assemblies each including a pair of support legs, said support legs of said respective support leg pairs extending toward each other in said horizontal position, and a support leg of each said respective support leg pairs extending beyond said upper door support frame and providing a carrying handle when said leg assemblies are positioned in said horizontal position.

12. The door fabrication station of claim 11 further including a pair of recesses in said upper door support frame positioned to receive a portion of said leg assemblies in said horizontal position.

* * * * *